US009022146B2

(12) United States Patent
Krueger et al.

(10) Patent No.: US 9,022,146 B2
(45) Date of Patent: May 5, 2015

(54) REVERSE CIRCULATION APPARATUS AND METHODS OF USING SAME

(75) Inventors: Sven Krueger, Niedersachsen (DE); Volker Krueger, Celle (DE); Jens-Uwe Bruns, Niedersachsen (DE); Karsten Fuhst, Hannover (DE); Joerg Breitenfeld, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 708 days.

(21) Appl. No.: 13/032,321

(22) Filed: Feb. 22, 2011

(65) Prior Publication Data

US 2011/0203848 A1 Aug. 25, 2011

Related U.S. Application Data

(60) Provisional application No. 61/306,679, filed on Feb. 22, 2010.

(51) Int. Cl.
*E21B 21/08* (2006.01)

(52) U.S. Cl.
CPC ..... *E21B 21/08* (2013.01)

(58) Field of Classification Search
USPC ..... 175/215, 217, 312, 314, 324
See application file for complete search history.

(56) References Cited

U.S. PATENT DOCUMENTS

| | | | | |
|---|---|---|---|---|
| 2,946,565 | A * | 7/1960 | Williams | 166/264 |
| 3,417,830 | A * | 12/1968 | Nichols | 175/209 |
| 4,223,747 | A | 9/1980 | Marais | |
| 6,857,486 | B2 * | 2/2005 | Chitwood et al. | 175/104 |
| 6,997,272 | B2 * | 2/2006 | Eppink | 175/61 |
| 7,055,627 | B2 | 6/2006 | Fontana et al. | |
| 7,204,327 | B2 * | 4/2007 | Livingstone | 175/318 |
| 7,270,185 | B2 | 9/2007 | Fontana et al. | |
| 2004/0118614 | A1 | 6/2004 | Galloway et al. | |
| 2008/0264692 | A1 * | 10/2008 | Underwood et al. | 175/106 |

FOREIGN PATENT DOCUMENTS

EP 1927721 A1 * 6/2008

OTHER PUBLICATIONS

Abyzbayev B.I. et al., "Electrodrilling; Past Experience and Present Opportunities," 1997 SPE Annual Technical Conference and Exhibition, San Antonio, Texas, Oct. 5-8, 1997, pp. 573-588.

Lurie, Paul et al., "Smart Drilling with Electric Drillstring," SPE/IADC 79886, SPE/IADC Drilling Conference, Amsterdam, The Netherlands, Feb. 19-21, 2003, pp. 1-13.

* cited by examiner

*Primary Examiner* — Giovanna Wright
*Assistant Examiner* — Richard Alker
(74) *Attorney, Agent, or Firm* — Cantor Colburn LLP

(57) ABSTRACT

In one aspect, an apparatus for drilling a wellbore into an earth formation is disclosed, which apparatus, according to one embodiment, may include a drill string configured to be conveyed into a wellbore, wherein an annulus is formed between the drill string and a wellbore wall, a first flow device configured to circulate a first fluid from an annulus to a bore of the drill string, and a second flow device positioned downhole of the first flow device, the second flow device configured to circulate a second fluid from the bore of the drill string to the annulus.

15 Claims, 3 Drawing Sheets

REVERSE CIRCULATION APPARATUS AND METHODS OF USING SAME

CROSS REFERENCES TO RELATED APPLICATIONS

This application claims priority from the U.S. Provisional Patent Application having the Ser. No. 61/306,679 filed Feb. 22, 2010.

BACKGROUND OF THE DISCLOSURE

1. Field of the Disclosure

This disclosure relates generally to oilfield wellbore drilling apparatus and more particularly to reverse drilling fluid circulation apparatus and systems and methods of using the same.

2. Background of the Art

Oilfield wellbores are drilled by rotating a drill bit conveyed into the wellbore by a drill string. The drill string includes a drill pipe or drill string (tubing) that has at its bottom end a drilling assembly (also referred to as the "bottomhole assembly" or "BHA") that carries the drill bit for drilling the wellbore. The drill pipe is made of jointed pipes. Alternatively, coiled tubing may be utilized to convey the drilling assembly. The drilling assembly usually includes a drilling motor or a "mud motor" that rotates the drill bit. The drilling assembly also includes a variety of sensors for taking measurements of a variety of drilling, formation and BHA parameters. A suitable drilling fluid (commonly referred to as "mud") is supplied or pumped under pressure from a source at the surface into the tubing. The drilling fluid drives the mud motor and then discharges at the bottom of the drill bit. The drilling fluid returns uphole via the annulus between the drill string and the wellbore and carries with it pieces of formation (commonly referred to as "cuttings") cut or produced by the drill bit during drilling of the wellbore.

For drilling wellbores under water (referred to in the industry as "offshore" or "subsea" drilling), tubing is provided at a work station (located on a vessel or platform). One or more tubing injectors or rigs are used to move the tubing into and out of the wellbore. For sub-sea drilling, a riser, formed by joining sections of casing or pipe, is deployed between the drilling vessel and the wellhead equipment at the sea bottom and utilized to guide the tubing to the wellhead. The riser also serves as a conduit for fluid returning from the wellhead to the sea surface.

During drilling with conventional drilling fluid circulation systems, the drilling operator attempts to control the density of the drilling fluid supplied to the drill string at the surface so as to control pressure in the wellbore, including the bottomhole pressure. During such drilling, the surface pump supplies the drilling fluid into drill string that discharges at the drill bit bottom and moves upwards (toward the surface) through the annulus. Accordingly, the surface pump must overcome the frictional losses along both fluid paths (downward and upward). Moreover, the surface pump must maintain a flow rate in the annulus that provides sufficient fluid velocity to carry the rock bits disintegrated by the drill bit (referred to as "drill cuttings") to the surface. Thus, in this conventional arrangement, the pumping capacity of the surface pump is typically selected to (i) overcome frictional losses present as the drilling fluid flows through the drill string and the annulus; and (ii) provide a flow velocity or flow rate that can carry or lift the cuttings through the annulus. Such pumps have relatively large pressure and flow rate capacities. Sometimes, the fluid pressure needed to provide the desired fluid flow rate through the annulus can fracture the earth formation surrounding the wellbore and thereby compromise the integrity of the wellbore at the fracture locations.

In another drilling arrangement, a surface pump is used for pumping the drilling fluid into the annulus between the drill string and the wellbore wall. The return fluid flows up the drill string tubular, carrying with it the drill cuttings. In such an arrangement, the surface pump has the burden of flowing the drilling fluid down the annulus and upwards along the drill string. Accordingly, the surface pump must overcome the frictional losses along both of these paths. However, due to the smaller cross-sectional area of the drill string compared to the annulus, the flow rate can be reduced assuming the same critical flow velocity for hole cleaning (transporting the cuttings to the surface). Thus, in such an arrangement, the pumping capacity of the surface pump is typically selected to (i) overcome frictional losses present through the annulus and the drill string; and (ii) provide a flow velocity or flow rate that can carry or lift the cuttings through the drill string. It will be appreciated that such pumps also have relatively low flow rate capacities.

The present disclosure provides drilling apparatus methods that address some of the above-noted and other drawbacks of conventional fluid circulation systems for drilling of wells.

SUMMARY

In one aspect, an apparatus for drilling a wellbore into an earthen formation is provided. One embodiment of the apparatus includes a first flow device configured to circulate a first fluid from an annulus to a drill string conveyed into the wellbore; and a second flow device positioned downhole of the first flow device configured to circulate a second fluid from the bore of the drill string to the annulus. In one aspect, the apparatus may further include an electric motor configured to drive a drill bit attached to a bottom end of the drill string. In another aspect, a separator between the first and second flow devices is configured to define, at least in part, a first flow loop associated with the first fluid and a second flow loop associate with the second fluid.

In another embodiment, the apparatus includes a drilling tubular configured to move fluid from the wellbore to a surface location; and a drilling assembly adapted for coupling to the drilling tubular, wherein the drilling assembly includes a drill bit, a motor configured to rotate the drill bit, and a fluid flow device uphole of the motor configured to pump a fluid received from the drill bit into the drilling tubular.

Examples of the more important features of the disclosure have been summarized (albeit rather broadly) in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, reference should be made to the following detailed description of the disclosure, taken in conjunction with the accompanying drawing.

DETAILED DESCRIPTION

Figure 1:
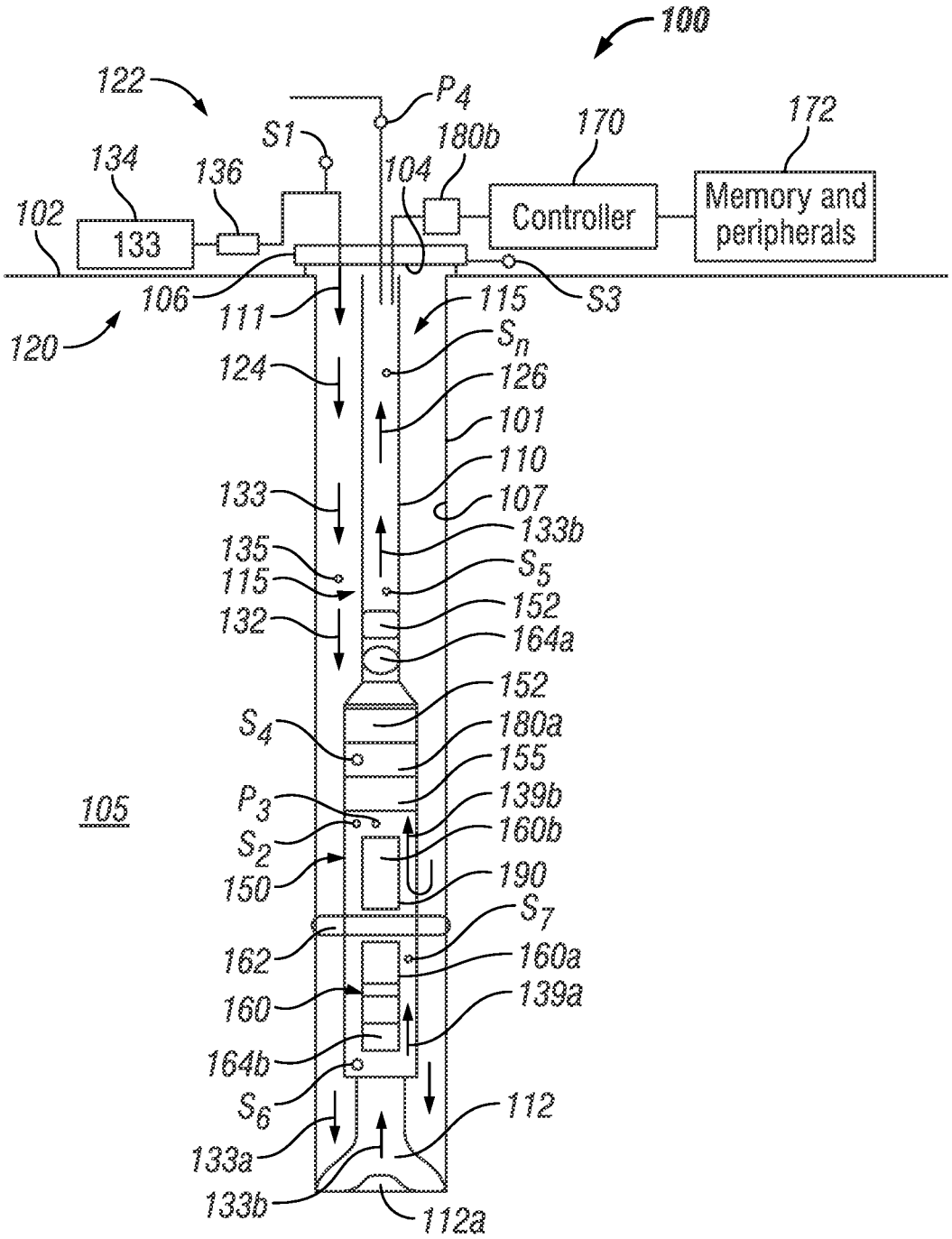
FIG. 1 is a schematic elevation view of well construction system using a fluid circulation device made in accordance with one embodiments of the present disclosure.

FIG. 1 is a schematic diagram of an exemplary drilling system 100 for drilling a wellbore 101. The system 100 is shown to include a drilling platform 102 situated on land for drilling the wellbore 101 in a formation 105. The drilling platform 102 may also be placed on an offshore drilling platform or vessel for offshore well operations. For offshore operations, additional equipment, such as a riser and subsea wellhead will typically be used. To drill the wellbore 101, well control equipment 104 (also referred to as the wellhead equipment) is placed above the wellbore 101. The wellhead equipment 104 includes a blowout preventer stack 106 and other equipment, such as a mast, motors for rotating a drill string, etc. (not shown).

The system 100 further includes a drill string 115 that includes a drilling assembly or a bottomhole assembly ("BHA") 150 at the bottom of a suitable tubular member 110. In one embodiment, the drilling assembly 150 includes a drill bit 112 attached to its bottom end for disintegrating the formation 105 to form the wellbore 101. The tubular member 110 may be formed partially or fully of drill pipe, metal or composite coiled tubing, liner, casing or other known members. Additionally, the tubular member 110 may include data and power transmission carriers 111, such as fluid conduits, fiber optics, and metal conductors. To drill the wellbore 101, the BHA 150 is conveyed from a drilling platform (not shown) to the wellhead equipment 104 and then into the wellbore 101. The drill string 115 includes a bore to convey and remove fluid from the wellbore to the surface. The tubular member 110 is moved into and out of the wellbore 101 to perform various drilling operations.

In accordance with one aspect of the present disclosure, the system 100 includes a fluid circulation system 120 that includes a surface drilling fluid or mud supply system 122, a supply line 124, and a fluid return line 126. The supply line 124 includes an annulus 135 formed between the drill string 115 and wellbore wall 107. During drilling, the surface mud supply system 122 supplies a drilling fluid or mud to the fluid supply line 124, the downward flow of the drilling fluid through the annulus 135 being represented by arrow 132. The mud system 122 includes mud 133 and a pit or supply source 134. In exemplary offshore configurations, the supply source 134 may be located at the platform, on a separate rig or vessel, at the seabed floor, or at another suitable location. In one embodiment, the supply source 134 is a variable-volume tank positioned at a seabed floor. While gravity may be used as the primary mechanism to induce flow of the drilling fluid 133 through annulus 135, one or more pumps 136 may be utilized to pump the drilling fluid 133 into the annulus 135. The drill bit 112 disintegrates the formation (rock) into cuttings (not shown), thereby forming the wellbore 101. In one embodiment, a drilling fluid 133*a* in the annulus 135 enters the drill bit 112 at or proximate to its bottom 112*a* and travels uphole through the return line 126 carrying the drill cuttings therewith. The fluid 133*a* and the cuttings 112*c* is referred to herein as the "return fluid" 133*b*. The return fluid 133*b* passes to a suitable storage tank at a seabed floor, a platform, a separate vessel, or to another suitable location. In one embodiment, the return fluid 133*b* discharges into a separator (not shown) that separates the cuttings and other solids from the return fluid 133*b* and discharges the clean fluid back into the mud supply source 134 at the surface or an offshore platform.

In one embodiment of the present disclosure, the BHA 150 may include a fluid flow device 160 (such a device also is referred herein as a "flow device" or "fluid circulation device") configured to cause the fluid 133*b* to flow through the return line 126. In embodiment, the fluid circulation device 160 may include more than one fluid circulation devices, for example one fluid circulation device 160*a* for circulating a first fluid or a first portion of the fluid 133 from the annulus 135 through a lower portion of the drilling assembly 150, as shown by dotted arrow 139*a* and another fluid circulation device 160*b* for circulating a second fluid or a second portion of the fluid 133 through the return line 126, such as shown by dotted 139*b*. An isolator 162 and other devices may be used to provide the fluid circulation paths 139*a* and 139*b*. Certain embodiments of the flow circulation devices are described in more detail in reference to FIGS. 2-5.

The system 100 also includes downhole devices that separately or cooperatively perform one or more functions such as controlling the flow rate of the drilling fluid 133 and controlling the flow paths of the drilling fluid. For example, the system 100 may include one or more flow-control devices that control the flow of the fluid in the tubular 110 and/or the annulus 135. In one aspect, a flow control device 152 may be activated when a particular condition occurs to isolate the fluid on either side (uphole or downhole) of a flow control device. For example, the flow-control device 152 may be activated to block fluid flow when drilling fluid circulation is stopped so as to isolate the sections above and below the device 152, thereby maintaining the wellbore below the device 152 at or substantially at the pressure condition of the wellbore prior to stopping of the fluid circulation.

In another aspect, the system 100 also may include downhole devices for processing the cuttings (e.g., reducing the cutting size) and other debris flowing in the tubular 110. A comminution device (such as crusher, mill, pulverizer, etc.) may be disposed at any suitable location in the drill string, such as a device 164*a* in the tubular 110 upstream of the fluid circulation device 160 and/or a device 164*b* in the drilling assembly 150 to reduce the size of the cuttings and other debris. The comminution devices 164*a* and/or 164*b* may be any suitable devices and may include known components, such as blades, teeth, or rollers to crush, pulverize or otherwise disintegrate solids in the fluid flowing in the tubular 110. The comminution device 164*a* and/or 164*b* may be operated by an electric motor, a hydraulic motor, by rotation of drill string or other suitable devices. The comminution devices 164*a* and/or 164*b* may also be integrated into the fluid circulation devices 160*a* and 160*b* as the case maybe. For instance, if a multi-stage turbine is used as the fluid circulation device 160, then the stages adjacent to the inlet to the turbine can be replaced with blades adapted to cut or shear particles before they pass through the blades of the remaining turbine stages.

Still referring to FIG. 1, the system 100 includes sensors, such as sensors $S_1$-Sn positioned throughout the system 100 to provide information or data relating to one or more selected parameters of interest (such as pressure, flow rate, temperature, downhole drilling conditions, etc.) In one embodiment, the devices and sensors $S_1$-$S_n$ communicate with a controller 170 via communication links (not shown). Using data provided by the sensors $S_1$-$S_n$, the controller 170 may, for example, maintain the wellbore pressure at a selected zone at a selected pressure or range of pressures and/or optimize the flow rate of drilling fluid. The controller 170 may maintain the selected pressure or flow rate by controlling the fluid circulation device 160 (e.g., adjusting amount of energy added to the return line 126) and/or other downhole devices (e.g., adjusting flow rate through a restriction such as a valve). Alternatively or in addition to controller 170, a downhole controller 190 may be used to control the operations of the fluid circulation device 160. The controllers 170 and/or 190 may include one or more processors, that execute programmed instructions to control one or more operations of the flow circulation device 160 and other components of the system 100.

When configured for drilling operations, the sensors $S_1$-$S_n$ provide measurements relating to a variety of drilling parameters, such as fluid pressure, fluid flow rate, rotational speed of pumps and like devices, temperature, weight-on bit, rate of penetration, etc., drilling assembly parameters, such as vibration, stick slip, RPM, inclination, direction, BHA location, etc. and formation or formation evaluation parameters commonly referred to as measurement-while-drilling parameters such as resistivity, acoustic, nuclear, NMR, etc. The devices and sensors for determining formation parameters are collectively referred by numeral 155. Devices and sensors 155 may be referred to as measurement-while-drilling or logging-while drilling sensors or devices. Also, one or more pressure sensors $P_1$-$P_n$ may be utilized for measuring pressure at one or more locations. The pressure sensors may provide data related to pressure in the drilling assembly 150, annulus 135, the fluid lines 124 and 126, pressure at the surface, and pressure at any other desired place in the system 100. Additionally, the system 100 includes fluid flow sensors such as sensors that provide measurement of fluid flow at one or more places in the system 100.

Further, the status and condition of equipment as well as parameters relating to ambient conditions (e.g., pressure and other parameters listed above) in the system 100 may be monitored by sensors positioned throughout the system 100: exemplary locations including at the surface ($S_1$), at the fluid circulation device 160 ($S_2$), at the wellhead equipment 104 ($S_3$), in the supply fluid ($S_4$), along the tubular 110 ($S_5$), drilling assembly 150 ($S_6$), in the return fluid upstream of the fluid circulation device 160 ($S_7$), and in the return fluid downstream of the fluid circulation device 160 ($S_8$). Other locations may also be used for the sensors $S_1$-$S_n$ The controller 170 may be a rugged controller suitable for drilling operations and may have access to programs for maintaining the wellbore pressure at under-balance condition, at at-balance condition or at over-balanced condition. The controller 170 includes one or more processors that process signals from the various sensors in the drilling assembly 150 and also controls their operations. The data provided by these sensors $S_1$-Sn and control signals transmitted by the controller 170 to control downhole devices, such as devices 150 and 160, are communicated by suitable two-way telemetry units 180*a* and 180*b*. The controller 170 may be coupled to appropriate memory, programs and peripherals 172 used to access and run the system 100. Also, a separate processor may be used for any sensor or device. Each sensor may also have additional circuitry for its unique operations. The controllers 170 and 190 are used herein in the generic sense for simplicity and ease of understanding and not as a limitation because the use and operation of such controllers is known in the art. The controllers 170 and 190 include one or more microprocessors or micro-controllers for processing signals and data and for performing control functions, solid state memory units for storing programmed instructions, models (which may be interactive models) and data, and other necessary control circuits. The microprocessors control the operations of the various sensors, provide communication among the downhole sensors and provide two-way data and signal communication between the drilling assembly 150, downhole devices such as devices 160 and other devices in the drill string and the surface equipment via the two-way telemetry units 180*a* and 180*b*.

In aspects, during drilling, the downhole controller 190 may collect, process and transmit data to the surface controller 170, which controller further processes the data and transmits appropriate control signals downhole. Other variations for dividing data processing tasks and generating control signals may also be used. In general, however, during operation, the controller 170 receives information regarding a parameter of interest and adjusts one or more downhole devices and/or fluid circulation device 160 to provide the desired pressure or range of pressure in the vicinity of any zone of interest.

Figure 2:
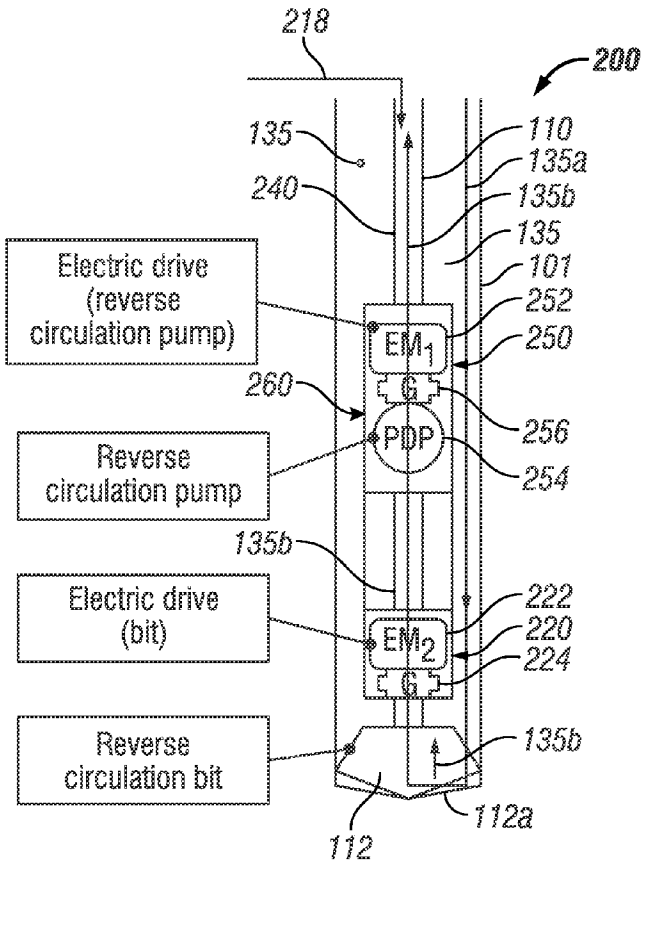
FIG. 2 is a schematic illustration of an arrangement of a reverse fluid circulation devices in a drill string according to one embodiment of the disclosure.

FIG. 2 is a schematic illustration of a reverse circulation apparatus or system 200 according to one embodiment of the disclosure. System 200 is shown to include a wellbore 101 in which a drill string 240 is conveyed for drilling the wellbore 101. A drilling assembly 250 is shown attached to the bottom of a tubular 110 of the drill string 240. The drill bit 112 is shown attached to the bottom of the drilling assembly 250. The drilling assembly 250 includes a drive unit 220 configured to rotate a drill bit 112 and a fluid circulation unit 260 configured for reverse circulation of a drilling fluid 135*a*. The drive unit 220 includes a drive 222 and a gear reduction device 224 coupled to the drill bit 112. The drive unit 220 rotates the drill bit 112 to form the wellbore 101. In one aspect, the drive 222 may be an electric motor of suitable power to rotate the drill bit 112 at a desired rotational speed (revolutions per minute (RPM)). The fluid circulation unit 260, in one embodiment, may include a drive 252 configured to operate or drive a pump 254 to lift the fluid from the drill bit bottom 112*a* into the tubular 110. The drive 252 may be an electric motor and the pump 254 may be any suitable positive displacement pump. A gear reduction device 256 may be coupled between the drive 252 and the pump 254 for driving the pump 254. During drilling operations, the drilling fluid 135*a* flows from the surface into the annulus 135, the drill bit rotation cuts the formation producing drill cuttings. The drilling fluid 135*a* and cuttings entering the drill bit 112, collectively referred to as the return fluid 135*b*, are lifted by the fluid circulation unit 260 and discharged into the tubular 110. The return fluid 135*b* flows along tubular 110 and discharges into the surface supply unit 134, as described in reference to FIG. 1. The reverse fluid circulation flow path is shown by arrows 135*a* and 135*b*. In aspects, the flow control device 260 alone, or in combination with, the surface fluid supply unit 122 (FIG. 1) and various other devices described herein may be utilized to control the pressure in the annulus and the drill string as well as desired levels of fluid flow therethrough. A power and data line or link 218 associated with the drill string 240 may be utilized for two-way data transfer and to supply power to the various components of the drilling assembly 250 and other downhole equipment. Alternatively, a downhole power generation unit (not shown), such as a generator driven by a fluid-driven turbine, may be used for supplying the power to the various components of the drilling assembly 250. Mud pulse telemetry, electromagnetic telemetry, acoustic telemetry, wired pipe, etc. may also be utilized as two-way telemetry devices.

Figure 3:
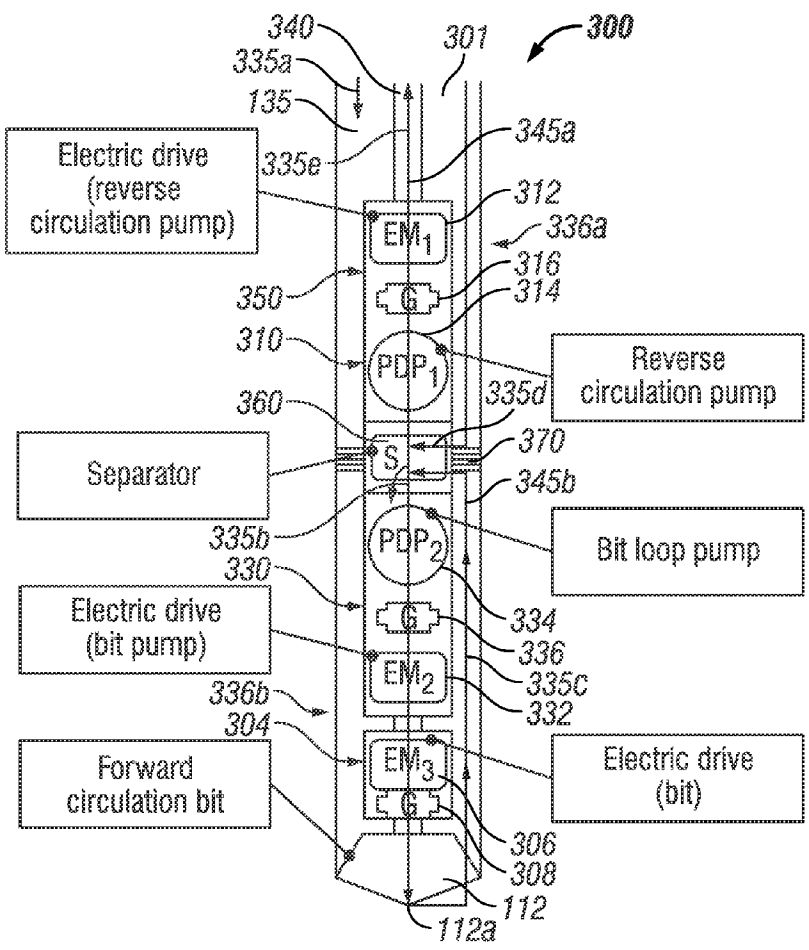
FIG. 3 is a schematic illustration of one embodiment of an arrangement according to the present disclosure wherein a wellbore system uses a fluid circulation having two fluid circulation loops.

FIG. 3 is a schematic illustration of a reverse circulation system 300 according to another embodiment of the disclosure. System 300 includes a drilling assembly 350 that includes a first or upper fluid circulation unit 310, a second or lower fluid circulation unit 330 and a separator 360 between the upper fluid circulation unit 310 and the lower fluid circulation unit 330. The separator 360 may also be referred to as a cross over flow device. An isolator 370 (or shroud) on the drilling assembly 250 may be configured to isolate the portion of the wellbore annulus 135 surrounding the drilling assembly 350 into two zones: an upper zone 336*a* and a lower zone 336*b*. The drilling assembly 350 further includes a drill bit 112 driven by a drive unit 304. In operation, the fluid 335*a* (drilling fluid or mud) flows from the surface through the annulus 135 and enters the separator 360. A portion 335*b* of the fluid 335*a* flows into the lower fluid flow circulation unit 330. The lower fluid circulation unit 330 pumps the fluid 335*b* into the drill bit 112. In addition, the drive unit 304 rotates the drill bit 112. In one embodiment, the drive unit 304 may include a motor 306, such as an electric motor, and a gear reduction device 308 coupled to the drill bit for rotating the drill bit 112. The lower fluid circulation unit 330, in one embodiment, may include a motor 332 that drives a pump 334 via a gear reduction unit 336. The drilling fluid 335*b* discharges at the drill bit bottom 112*a* and entraps the cuttings from the wellbore. The combination of the fluid 335*b* and the cuttings (collectively fluid 335*c*) moves upward in the lower section 336*b* of the annulus 135. The isolator 370 causes the fluid 335*c* to flow into the separator 360, which then directs the fluid into tubular 340.

As depicted, a second portion 335*d* of the fluid 335*a* moves into the separator 360 and then into the upper fluid circulation unit 310. Fluid 335*d* mixes with fluid 335*c* in the separator 360. The combination of the fluids 335*c* and 335*d* is referred to as fluid 335*e*. The upper fluid circulation unit 310 includes a motor 312 that drives a pump 314 via a gear device 316. The pump 314 pumps the fluid 335*e* from the upper fluid circulation device 310 into the tubular 340. The fluid 335*e* is then directed to the surface. The fluid circulation system 300 thus provides a first or upper fluid circulation path, generally denoted by 345*a*, which includes a substantial portion of the fluid 335*a* supplied to the annulus 135. The upper fluid circulation path 345*a* is a reverse circulation path, i.e., the fluid flows from the annulus 135 to the tubular 340 and then to the surface 102. The lower fluid circulation path, generally denoted by 345*b*, is in opposite direction to the upper fluid circulation path 345*a*. The fluid flows from the drilling assembly 350 to the drill bit 112 and then upward in the lower section 336*b*. In the system 300, different pressures may be maintained in the upper section 336*a* of the annulus 135 and the lower section 110*b* of the annulus 135 by controlling the operation and pumping of fluid circulation units 310 and 330. The controllers 170 and/or controller 190 may control the operations of the flow circulation devices 310 and 330, drive unit 304 and any other devices using programs 172 as described in reference to FIG. 1.

Figure 4:
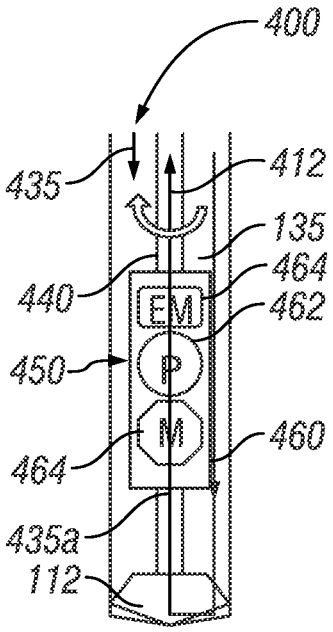
FIG. 4 is a schematic illustration of the fluid circulation system of FIG. 2 that includes a device for crushing cuttings.

FIG. 4 is a schematic illustration of a reverse circulation system 400 according to yet another embodiment of the disclosure. System 400 includes a drill string 440 with a drilling tubular 412 coupled to a drilling assembly 450, having a drill bit 112 attached to the bottom of the drilling assembly 450. In the system 400, the drill bit 112 is rotated by rotating the drill string 440 from the surface. The drilling fluid 435 supplied to the annulus 135 enters the drill bit 112. The drilling fluid 435 and cuttings (collectively fluid 435*a*) are lifted by a pump 462. The pump 462 is operated by a motor 464 and pumps the fluid 435*a* to the drilling tubular 412. A suitable cutting mill or crusher 460 in the drilling assembly 450 may be provided to crush drill cuttings before the fluid 435*a* enters the pump 462.

Figure 5:
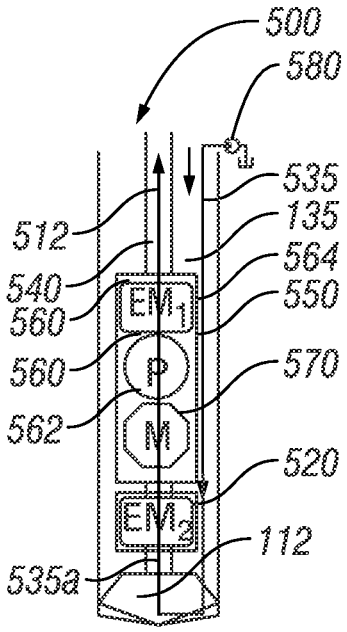
FIG. 5 is a schematic illustration of the fluid circulation arrangement of FIG. 4, wherein fluid is pumped into the annulus from the surface to control the pressure in the annulus.

FIG. 5 is a schematic illustration of a reverse circulation system 500 according to yet another embodiment of the disclosure. System 500 includes a drill string 540 that has a tubular 512 coupled to a drilling assembly 550, having a drill bit 112 attached to the bottom of the drilling assembly 550. In the system 500, the drill bit 112 is rotated by drive unit 520 in the manner described in reference to FIG. 2. In this embodiment, the drilling fluid 535 is pumped under pressure into the annulus 135 by a surface pump 580. A suitable cutting mill or crusher 570 in the drilling assembly 550 crushes drill cuttings before a mixture 535*a* of the fluid 535 and cuttings enters the fluid circulation unit 560. The fluid circulation unit 560 includes a pump 562 driven by a motor 564.

Thus, in one aspect, an apparatus for drilling a wellbore into an earthen formation is disclosed, which apparatus, according to one embodiment, may include a drill string configured to be conveyed into a wellbore, wherein an annulus is formed between the drill string and a wellbore wall, a first flow device configured to circulate a first fluid from an annulus to a bore of the drill string, and a second flow device positioned downhole of the first flow device, the second flow device configured to circulate a second fluid from the bore of the drill string to the annulus. The apparatus may further include a separator configured to transfer solids from the second fluid to the first fluid. In one embodiment, the first flow device has a flow rate that is different from a flow rate of the second device. In another embodiment, the apparatus further includes a device, such as a shroud, configured to substantially separate the first fluid from the second fluid. In another aspect, the first flow device circulates the first fluid between a surface location and a selected location on the drill string, and the second flow device circulates the second fluid between the selected location and a distal end of the drill string. In one configuration, an electric motor may be utilized to energize the first flow device and/or the second flow device. The drill string may include a drill bit connected to an end of the drill string and an electric motor configured to rotate the drill bit. In a particular configuration, the second flow device may be a progressive cavity pump, an axial flow pump, or a radial flow pump. In yet another aspect, the first flow device has a flow rate that is different from a flow rate of the second flow device.

In another aspect, an apparatus for use in a wellbore is provided, which apparatus, in one embodiment, may include a tubular configured to move fluid from the wellbore to a surface location, and a drilling assembly adapted for coupling to the drilling tubular. The drilling assembly may include a drill bit, an electric motor configured to rotate the drill bit and a fluid circulation device uphole of the motor configured to pump a fluid received from the drill bit into the drilling tubular. In one embodiment, the apparatus further includes a crusher configured to crush cuttings cut by the drill bit. In aspects, the crusher may be placed downhole of the motor, between the motor and the fluid circulation device or uphole of the fluid circulation device. The drilling fluid may be supplied under pressure from the surface.

Additionally, it should be appreciated that the present teachings are not limited to any particular reverse circulation system or device described above. The teachings of the present disclosure may be readily and advantageously applied to conventional reverse circulating systems. Further still, while the present teachings have been described in the context of drilling, these teachings may also be readily and advantageously applied to other well construction activities such as running wellbore tubulars, completion activities, perforating activities, etc. That is, the present teachings can have utility in any instance where fluid, not necessarily drilling fluid, is reverse circulated in a wellbore.

While the foregoing disclosure is directed to certain embodiments of the disclosure, various modifications will be apparent to those skilled in the art. It is intended that all variations within the scope and spirit of the appended claims be embraced by the foregoing disclosure.

What is claimed is:

1. An apparatus for drilling a well bore in a formation, comprising:

a drilling assembly configured to be conveyed into the wellbore by a drill string, wherein an annulus is formed between the drilling assembly and the wellbore;

an isolator that isolates the annulus into an upper zone and a lower zone at a selected location uphole of a drill bit;

a first flow device in the drill string uphole of the selected location, configured to flow a first fluid and a second portion of a second fluid in the drill string uphole;

a second flow device positioned in the drill string downhole of the selected location, the second flow device configured to flow a first portion of the second fluid in the drill string to the drill bit; and a separator located at the drilling assembly between the first flow device and the second flow device and configured to direct the first fluid from the lower zone of the annulus to the first flow device, direct the second portion of the second fluid from the upper zone of the annulus to the first flow device, and direct the first portion of the second fluid from the upper zone of the annulus to the second flow device.

2. The apparatus of claim 1 wherein the first fluid is a fluid that has been discharged from the drill bit into the lower zone of the annulus.

3. The apparatus of claim 1 wherein the first flow device has a flow rate that differs from a flow rate of the second flow device.

4. The apparatus of claim 1 wherein the first flow device circulates the first fluid and the second portion of the second fluid between flail the selected location on the drill string and a surface location and the second flow device circulates the first portion of the second fluid between the selected location and a distal end of the drill string.

5. The apparatus of claim 1 further comprising an electric motor configured to energize one of: (i) the first flow device; and (ii) the second flow device.

6. The apparatus of claim 1 further comprising an electric motor configured to rotate the drill bit.

7. The apparatus of claim 1 wherein the second flow device is selected from a group consisting of: (i) a progressive cavity pump, (ii) an axial flow pump, and (iii) a radial flow pump.

8. The apparatus of claim 1 further comprising a device for reducing size of solids present in the second fluid.

9. A method of drilling a wellbore, comprising:

drilling the wellbore in a formation with a drilling assembly at an end of a drill string and having a drill bit at an end thereof, wherein an annulus is formed between the drilling assembly and the wellbore;

providing an isolator in the annulus that isolates the annulus into an upper zone and a lower zone at a selected location uphole of the drill bit;

flowing a first fluid from the lower zone of the annulus into a location in the drilling assembly uphole of the isolator and a first portion of a second fluid from the upper zone of the annulus into a location in the drilling assembly downhole of the isolator;

flowing a second portion of the second fluid from the upper zone of the annulus into the location in the drilling assembly uphole of the isolator;

using a first flow device to flow the first fluid and the second portion of the second fluid from the location in the drill string uphole of the isolator to a surface location; and using a second flow device to flow the first portion of the second fluid from the location in the drill string downhole of the isolator to the drill bit.

10. The method of claim 9 further comprising directing the first portion of the second fluid and cuttings produced by the drill bit are discharged from the drill string into the lower zone of the annulus.

11. The method of claim 10 further comprising reducing size of the cuttings produced by the drill bit.

12. The method of claim 9 further comprising rotating the drill bit by one of: an electric motor in the drill string; and rotating the drill string.

13. The method of claim 9 wherein at least one of the first flow device and the second flow device includes a pump driven by an electric motor.

14. The method of claim 9 wherein a flow rate of the first flow device differs from a flow rate of the second flow device.

15. An apparatus for drilling a wellbore into a formation, comprising:

a drill string configured to be conveyed into the wellbore, the drill string including a bottomhole assembly, wherein an annulus is formed between the drill string and the well bore;

an isolator that isolates the annulus into an upper zone and a lower zone;

a cross-over flow device configured to convey a first fluid from the lower zone of the annulus to a location in the drill string uphole of the isolator, convey a first portion of a second fluid from the upper zone of the annulus to a location in the drill string downhole of the isolator and convey a second portion of the second fluid from the upper zone of the annulus to the location in the drill string uphole of the isolator; and a first flow device configured to receive the first fluid from the cross-over flow device and the second portion of the second fluid and flow the received first fluid and second portion of the second fluid to the surface via a bore of the drill string.

* * * * *